US005285659A

United States Patent [19]

Bardisbanyan

[11] Patent Number: 5,285,659

[45] Date of Patent: Feb. 15, 1994

[54] METHOD AND APPARATUS FOR SETTING STONES IN JEWELRY

[75] Inventor: Vahran Bardisbanyan, Encino, Calif.

[73] Assignee: Marquesa, Inc., Van Nuys, Calif.

[21] Appl. No.: 953,724

[22] Filed: Sep. 29, 1992

[51] Int. Cl.[5] ..... A44C 17/02

[52] U.S. Cl. ..... 63/26; 59/80; 29/10

[58] Field of Search ..... 63/4, 7, 9, 26, 28, 63/18; 59/80, 82, 84, 85; 29/10

[56] References Cited

U.S. PATENT DOCUMENTS

| | | | |
|---|---|---|---|
| Re. 18,141 | 7/1931 | Speidel | 59/80 |
| 365,115 | 6/1887 | Bigney | 59/80 |
| 1,276,607 | 8/1918 | Anderson | 59/80 |
| 1,405,851 | 2/1922 | Lewis | 59/80 |
| 1,658,381 | 2/1928 | Kilstrom | 59/80 |
| 2,095,547 | 10/1937 | Girouard | 59/80 |
| 2,920,442 | 1/1960 | Kunzmann et al. | 59/80 |
| 3,292,401 | 12/1966 | Van Meter | 59/85 |
| 3,421,313 | 1/1969 | Harada et al. | 59/84 |
| 3,678,705 | 7/1972 | Korwin | 63/18 |
| 4,781,038 | 11/1988 | Branca et al. | 63/26 |

FOREIGN PATENT DOCUMENTS 27321 of 1903 United Kingdom ..... 59/80

*Primary Examiner*—Peter M. Cuomo
*Assistant Examiner*—Michael Milano
*Attorney, Agent, or Firm*—Levinsohn, Lerner & Berger

[57] ABSTRACT

A method and apparatus for mounting precious or semi-precious stones comprises a casting of pliable metal. The housing is formed into a pair of opposed channel-shaped legs which can be squeezed together to encircle and hold the girdle portion of the stone. To facilitate linking of two or more stones, one end of the mounting is provided with an ear having an aperture pass therethrough. The other end of the mounting is provided with a post. The post is securable to the free end of the opposed leg of the first mounting. If linking two mountings is desired, the post of a first housing passes through an aperture of an adjacent housing before the post is welded to the free end of the opposed leg.

21 Claims, 2 Drawing Sheets

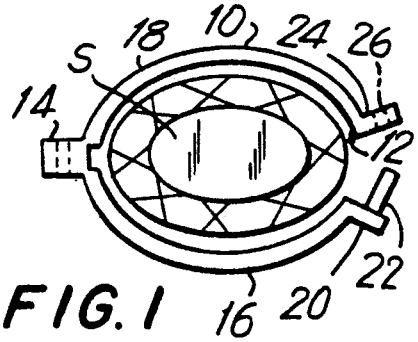
FIG. 1
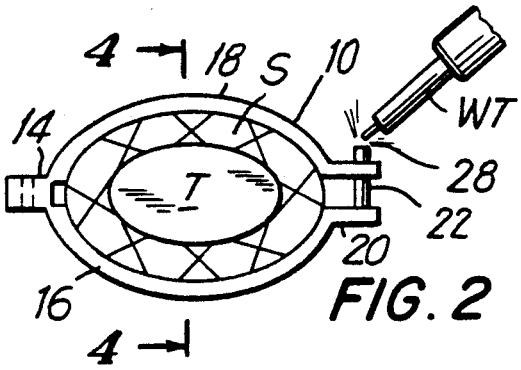
FIG. 2
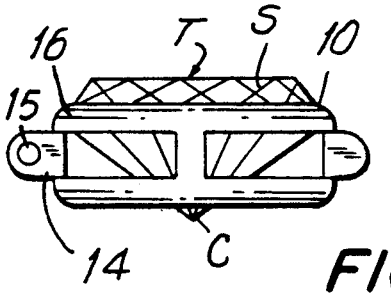
FIG. 3
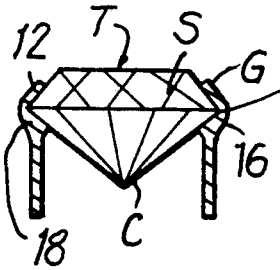
FIG. 4
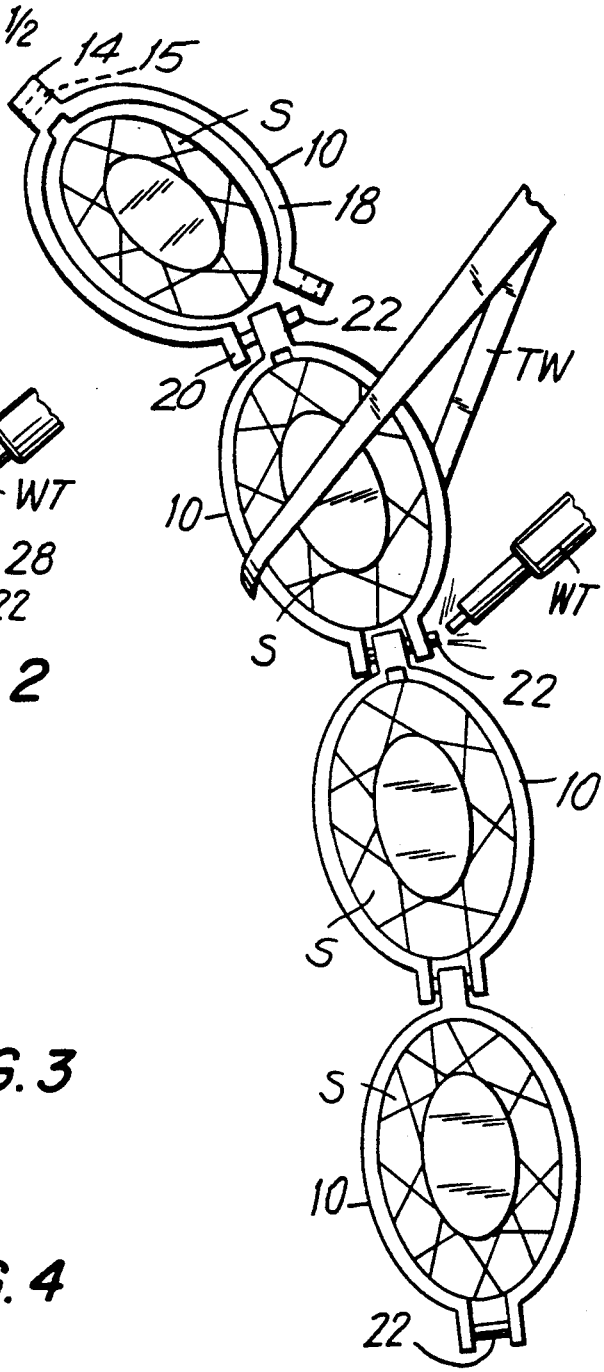
FIG. 6
FIG. 5
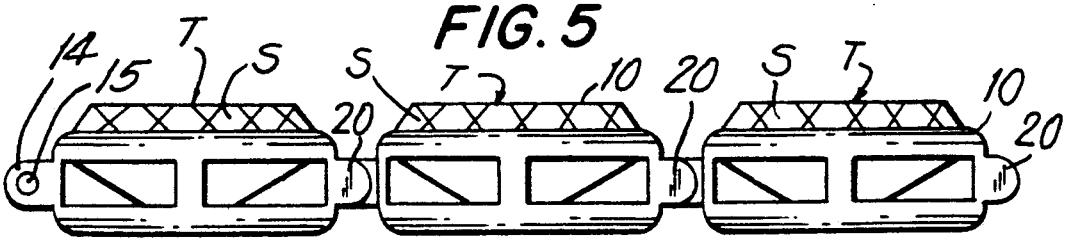

FIG. 7
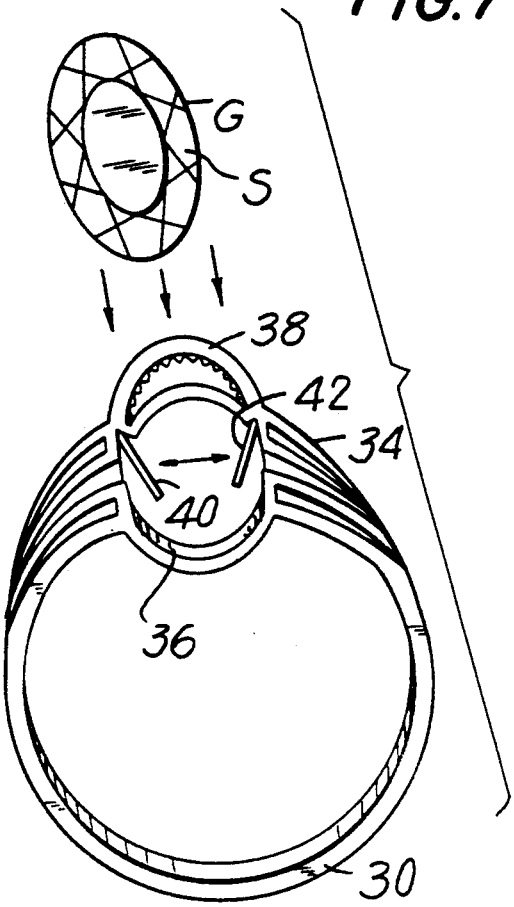
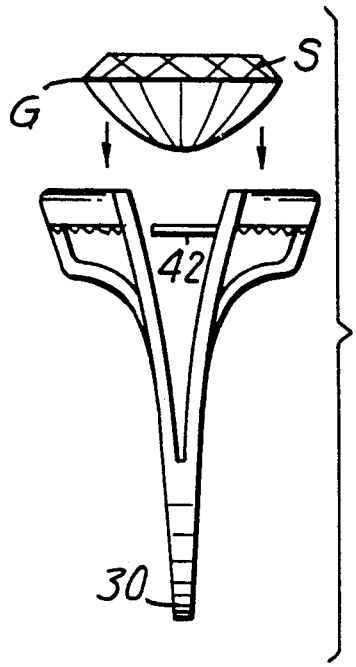
FIG. 9
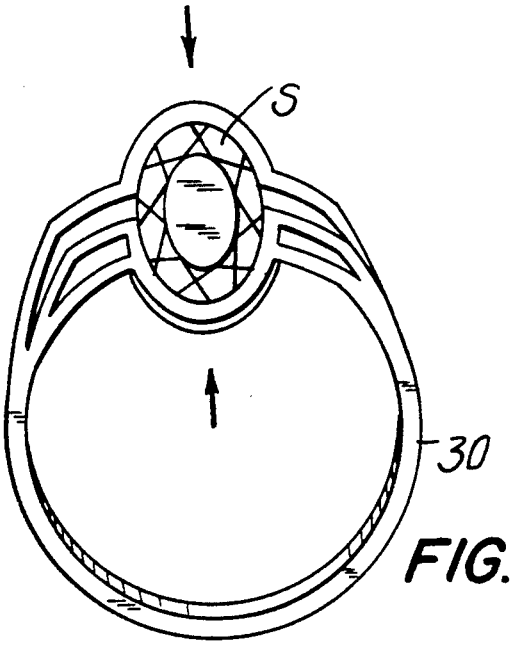
FIG. 8
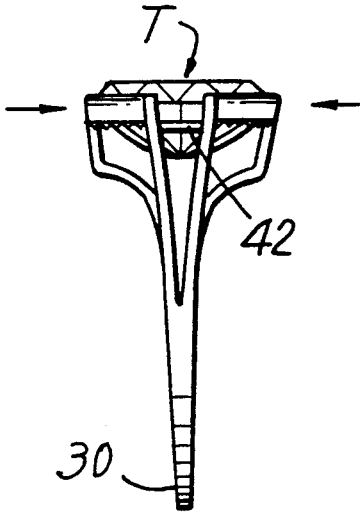
FIG. 10

METHOD AND APPARATUS FOR SETTING STONES IN JEWELRY

BACKGROUND OF THE DISCLOSURE

The present invention relates to a method and apparatus for setting stones in jewelry, and more particularly, to such a method and apparatus which reduces labor and material costs and simplifies stone assembly. The method and apparatus can be used to manufacture a ring, a pin, an earring, a bracelet or any other jewelry-like ornament. Individual stones are mounted at the same time that stones and their mountings are linked together. Two or more mounted stones can be easily linked together to form a chain.

The setting of stones, whether coloreds or diamonds in jewelry, especially rings, pins and bracelets, is often a time and labor intensive process. Conventionally each stone is mounted in its own housing or prong setting. If two or more stones are desirably connected together, the mountings are then linked into an article of jewelry. For purposes of illustrating and describing the present invention, the method and apparatus will be described primarily with respect to a segment of a bracelet which comprises many colored stones where individual mountings are linked together. The multiple stones and housings along with any additional chain portion and a clasp form a bracelet. Of course, the present invention can be easily adapted for use in connection with necklaces, pendants, pins and even individual stone settings as used in the design of rings.

According to the present invention, individual housings are formed from either channel wire or castings. The housings are formed into opposed channel shaped legs. When squeezed together, the legs substantially surround the girdle portion of the stones. One end of the housing is provided with another ear having an aperture passing therethrough. The opposite end of the oval housing is provided with a pin opposed to another ear also having an aperture. The stone is placed within the legs of the housing. As the legs are squeezed around the stone, the pin is inserted into its opposed aperture or hole. Then, the pin is welded to its opposed ear so that the legs tightly grasp and securely hold the stone.

If two or more mounted stones are desirably linked together to form a chain as, for example, for a bracelet or necklace, the pin is passed through the aperture of the first ear of a second housing. Then, the pin is welded to the opposed ear of the first housing. The channel housing is cast from a metal having sufficient flexibility to allow the sides of the housing to be pressed or pushed against the sidewall or girdle of the stone prior to welding of the pin into its opposed hole.

BRIEF DESCRIPTION OF THE PRIOR ART

There are, of course, many ways to mount or set colored stones or diamonds in manufacturing jewelry articles. For example, it has long been conventional to prong set individual stones. More recently, channel wire has been used to encircle the girdle portion of the stone with the ends of the channel wire then being soldered together. In addition, castings have been manufactured which include channel portions to encircle a colored stone. When the stone is inserted with its girdle held by the channels, one end of the cast piece is squeezed or crushed such that the stone is securely held.

U.S. Pat. No. 5,022,238 entitled "Setting for Fine and Costume Jewelry" by Hassan J. German describes an apparatus to set fine and costume jewelry. Frames of substantially similar dimensions are formed symmetrically about a foldable connecting bridge. A tab-like extension is formed on the frame. Similarly, another tab is formed on the overlying frame which is longer than the first tab. The frame is folded around the foldable connecting bridge and onto the other frame such that the two frames mate along their lengths with the stone contained therebetween. The extending portion of the longer tab is folded over the first tab to complete the fastening together of the two frames. The process set forth in the '238 patent requires multiple steps to set each stone and to join adjoining stones. The present invention represents an improvement over the prior art and the system described in the '238 patent. The device of the '238 patent requires two different elements for each stone setting. A one piece channel housing is used in the present invention. While the device of the '238 patent and the method described therein requires folding one tab over the other tab prior to welding, the present invention does not require such a labor and time intensive operation. As the channel shaped legs are squeezed together a pin is simply inserted through a hole to secure a stone and, at the same time, to link one stone and its mounting to another.

U.S. Pat. No. 2,852,923, issued Sep. 23, 1958 to Gamelsky, relates to a jewelry chain construction and method of manufacture for costume jewelry. As best seen by a review of FIGS. 1 through 3, a wire is used as the chain upon which findings 22 are firmly secured, preferable uniformly spaced apart, with each finding serving to mount and set a precious, semi-precious or imitation stone. The findings are bent around the wire and provide a box-like setting for the stones. To construct a bracelet, the method and apparatus described in the '923 patent requires a separate wire in addition to the box-like findings. This is in contrast to the present invention which contemplates a single component which provides a mounting or setting for individual stones with the channel housings being capable of being linked together to form a bracelet. Here, again, a decrease in the number of components necessary to form a bracelet results in efficiency in both materials and labor costs. Furthermore, the box-like findings of the '923 patent must be folded and bent in a manner described in the patent which is labor and time intensive. The present invention provides a simple and time efficient mechanism for mounting individual stones and, at the same time, connecting the mounted stones together to form a bracelet. Folding and bending along prescribed lines and angles is avoided by the present invention. A simple squeezing together of the channel housing is all that is necessary, followed by a simple welding step. The one-piece housing is far easier to manufacture and use. When secured, the housing forms a secure and visually pleasing mounting which can be linked to other housings to form a bracelet or other article of jewelry.

U.S. Pat. No. 1,326,977 issued Jan. 6, 1920 relates to a finger ring made from two components. When they are welded together, they form a prong-like setting for an individual stone. Again, the present invention contemplates a one piece channel housing which is capable of mounting stones securely and, when desired, also allows for the stones to be easily and inexpensively linked together to form an article of jewelry.

An object of the present invention is to provide an improved method and apparatus for stone setting. A quick and easy process is provided which utilizes, in addition to the colored stones or diamonds to be set, a one-piece casting of metal. The mounted and set stones are simultaneously secured by the squeezing and welding operation and, at the same time, are linked together to other channel housings to form a piece of jewelry. Reduction in the time to create a bracelet results in significant cost savings. In addition, reduction in the number of components necessary to form an article of jewelry also provides cost savings.

Other objects, advantages and features of the present invention will become more apparent from the following description.

SUMMARY OF THE INVENTION

In accordance with the principles of this invention, a colored precious or semi precious stone or diamond, such as an oval shaped stone is inserted into a cast metal mounting formed into a channel housing of two opposed legs. The channel housing is provided, on a first end, with an outwardly extending ear having an aperture therethrough. As originally cast or formed, the setting or housing is slightly larger than the stone sought to be set therein. The cross section of the legs of the casting have channel shapes so as to surround and firmly hold the girdle portion of the stone. One end of the leg of the setting, opposite to that end provided with the first ear and aperture just described, is provided with a pin. The other leg has, also at its end opposite to the first ear, another ear with a hole. The second ear has an aligned hole or aperture for receipt of the pin, when the legs are squeezed together.

The casting is made of a metal which is sufficiently pliable such that upon squeezing the legs together, the casting directly contacts and firmly secures the stone with the pin passing through the opposed aperture of the second ear. If it is desired to link together two or more mountings of the present invention, the pin, prior to being inserted into the aperture of the opposed ear, is passed through the aperture of the first ear of a second casting. With the pin then inserted through the hole of its second ear, the pin is welded. Thus, in one step, a stone is mounted and, at the same time, mountings for stones are joined together into a chain or bracelet.

BRIEF DESCRIPTION OF THE DRAWINGS

FIG. 1 is a top plan view showing a single cast housing and a single faceted stone prior to squeezing and welding of the housing;

FIG. 2 is a view similar to that shown in FIG. 1, but shows the stone secured within the cast housing and, in addition, schematically shows the welding tip for the welding operation;

FIG. 3 is a side elevation of the cast housing shown in FIG. 2 with a cut stone secured therein;

FIG. 4 is a cross-sectional view taken along lines 4—4 of FIG. 2 and shows the cut stone secured within the channel portions of the cast housing;

FIG. 5 is a side elevational view of three cast housings with stones mounted and set therein, formed according to the principles of the present method and apparatus; and FIG. 6 is a top plan view of the method and apparatus of the present invention showing four individual cast housings and associated cut stones as they are made into a bracelet. Tweezers and a welding tip are partially shown.

FIGS. 7–10 relate to a second embodiment of the present invention, as it is adapted for use in connection with the mounting of a single stone, preferably, for a ring.

FIG. 7 is a partial perspective view of the second embodiment of the present invention showing a cut stone about to be inserted into the cast ring;

FIG. 8 is a partial perspective view similar to that shown in FIG. 7 and shows the cut stone mounted in the channel setting of the ring;

FIG. 9 is a side elevational view of the present invention with a cut stone shown prior to insertion into the ring; and FIG. 10 is a side elevational view of the embodiment of the present invention shown in FIG. 8 with the cut stone inserted into and secured by the channel mounting of the present invention, formed into a ring.

DETAILED DESCRIPTION OF THE DRAWINGS AND THE PREFERRED EMBODIMENT

The present invention basically comprises a plurality of cast or formed housings 10, which are linked together to form an article of jewelry as, for example, a jewelry bracelet. Each housing 10 is intended to surround, mount and securely set a semi-precious stone or diamond S. For purposes of illustrating and describing the present invention, the stone S is oval in shape and has a plurality of facets. The girdle G or outside circumference of the stone S is intended to be inserted and held within the channel portions 12 of the legs of the housing 10. When mounted, the table T of the stone S will project above the top surface of the channel portions 12 and the culet C of the stone S will extend downwardly toward and, in some instances, below the bottom of the housing 10. Preferably, the housing is formed from a metal or metal alloy which is sufficiently rigid that, after forming, it will securely hold the stone over time and, yet, during the fabrication, manufacturing and mounting phases, can be bent and conform to the girdle of the stone when pressure is applied. The channel housing should mold and form to the shape of the stone. In this connection, silver or gold alloy, 14 or 18 carat are metals which have been found to be suitable. The channel portions 12 of the stone housing 10 are, preferably, cast or formed from channel wire. When made, in cross section, the legs have a "V" shaped cross section (See FIG. 4). The channels securely hold the girdle G of the stone S when a pair of pliers or tweezers TW (see FIG. 6) are used to squeeze together the channel portions 12.

One end of the housing 10 comprises a first ear portion 14 having an aperture 15 passing therethrough. The first ear portion 14, in this embodiment, projects outwardly from the channel portions 12 and is integrally cast or formed with the channel portions 12. Extending laterally, on both sides, from the ear portion 14, are legs 16 and 18 which, as mentioned, are formed from channel wire or otherwise cast into a "V" cross sectional shape so that the channel portions tightly grip the girdle G of the stone. Leg 16 terminates, opposite to ear portion 14, in a tab 20. Tab 20 has a pin or post 22 which projects at substantially right angles to tab 20. The diameter of post 22 is slightly less than the inside diameter of aperture 15 of ear portion 14 so that the post 22 of a first housing 10 can pass through the aperture 15 of an ear portion 14 of a second housing 10. This would be done when linking together two or more housings to form a bracelet.

Extending at right angles to leg 18 is a second tab 24 which has an aperture 26 passing therethrough. Aperture 26 is of a diameter slightly larger than the diameter of post 22 and is adapted to receive post 22 when the legs 16 and 18 are squeezed together, about the girdle G of a stone S, during the assembly operation. The length of the post 22 is, according to the preferred embodiment, slightly longer than the distance between tab 20 and second tab 24, so as to produce a slight extension 28 (see FIG. 2) which allows a welding tool or soldering tip WT to easily perform the welding operation.

The assembly procedure is as follows: A stone S preferably of oval shape is selected. The stone housing 10 of corresponding shape and dimensions is cast or formed. It is initially placed over the stone such that the channel portions 12 contact at least a portion of the circumference or girdle G of the stone S. Then, a pair of tweezers TW or pliers is brought to bear on the outside surface of the legs 16 and 18. The pliers are squeezed so that the legs 16 and 18 are forced towards each other with the channel portions 12 contacting the girdle portion G of the stone until the legs securely hold the stone. If it is desired to only set and mount a single stone, then the post 22 is inserted into the aperture 26 of the second tab 24 and a welding tool WT, in conventional manner, is applied to the extension 28. This will secure the post 22 to the outside of the second tab 24. In this manner, a single stone is securely held and mounted in a stone housing 10. A simple and cost efficient operation, using a single cast or formed metal component, is all that is required.

Alternatively, however, if it is desired to link together two or more stones and housings then, prior to the post 22 being inserted into the aperture 26 of the second tab 24, the post 22 is allowed to pass through the aperture 15 of ear portion 14 of a second stone housing. This is best illustrated in FIG. 6. Then, with the post 22 passing both through aperture 15 and, in addition, aperture 26 of second tab 24, the welding tool WT is applied to the extension 28 of the post 22. In this manner, two or more stones and stone housings can be linked together to form a bracelet in a time efficient and cost efficient manner. In this embodiment, the mounting of a stone occurs at the same time as linking together two housings.

An alternate embodiment of the present invention is shown in FIGS. 7–10. A ring is cast or formed from metal. The ring includes a band portion 30 which is sized so as to fit on the wearer's ring finger. The band portion 30 proceeds toward the mounting portion 32 with the band splitting into several legs 34. The ends of the legs turn at right angles to form two semi-circular stone holding portions 36 and 38. In cross section, the stone portions 36 and 36 have a "V" shape and are preferably formed from channel wire. It is the portions 36 and 38 which surround the girdle G of the stone S when the stone is inserted, according to the method of the present invention.

At each end of the base of semi-circular stone holding portion 38, extending toward semi-circle 36, is one of a pair of posts 40 and 42. This is best shown in FIGS. 7 and 8.

According to the present invention, a stone is selected by the jeweler. A ring having a band 30, semi-circular stone holding portions 36 and 38 and pre-sized channels is selected to fit the finger and the selected stone. A pair of pliers or tweezers are used to squeeze semi-circular portions 36 and 38 toward one another so that the girdle G of the stone S is securely contained within the channel portions of the stone holding portions 36 and 38. This secures the stone in location. The stone S is squeezed between semi-circular portions 36 and 38 until the posts 40 and 42 either project through apertures (not shown) in the opposed split legs 34 or, alternatively, the ends of the posts 40 and 42 will directly abut against the other semi circular stone holding portion. Then, a welding tool WT can be utilized to secure the ends of the posts to the opposed surface. In this manner, the jewel is provided with a channel mounting in a simple and cost effective manner by utilization of a single cast or formed component.

This invention has been described in accordance with a preferred embodiment and the appended claims describe the scope of protection to which the inventor is entitled. Modifications and changes may be made by those of ordinary skill in the art which will still fall within the scope of the invention as set forth in the claims.

I claim as follows:

1. A jewelry mounting for a stone having a girdle, said mounting comprising a housing having a pair of opposed channel-shaped legs, each having a first end and a free end, said channel-shaped legs being capable of surrounding and securely holding said girdle of said stone from both above and below, said channel shaped legs meeting at said first ends in an extending ear having an aperture therethrough, said free end of a first of said channel-shaped legs, opposite to said extending ear, having a post, smaller in diameter than said aperture and securable to the free end of said opposed channel shaped leg when said channel shaped legs are squeezed into contact with said girdle of said stone.

2. A jewelry mounting as claimed in claim 1 wherein said housing is a one-piece casting.

3. A jewelry mounting as claimed in claim 1 wherein said stone is oval and said channel-shaped legs are complimentary to the girdle of said stone.

4. A jewelry mounting as claimed in claim 1 wherein said stone is round and said channel-shaped legs are complimentary to the girdle of said stone.

5. An article of jewelry comprising two or more jewelry mountings as claimed in claim 1, wherein two or more of said housings are connected together into linked pairs by having said post of a first of said pair of housings pass through said aperture of said extending ear of a second housing of said pair.

6. A jewelry mounting as claimed in claim 1 wherein said channel-shaped legs, in cross section, are "V" shaped.

7. A jewelry mounting as claimed in claim 1 wherein said channel-shaped legs are, in cross section, complimentary to the girdle portion of said stone.

8. A jewelry mounting as claimed in claim 1 wherein said channel-shaped legs are manufactured from a material strong enough to safely secure said stone and capable of being squeezed manually together to directly contact the girdle of said stone.

9. A jewelry mounting as claimed in claim 1 wherein said post is soldered to the free end of said second channel-shaped leg.

10. A method of mounting a stone having a girdle comprising the steps of:

(a) providing a one-piece housing having girdle engaging legs, said legs having free ends, said free ends of said legs being opposite to each other, a first tab at one of said free ends of said legs having an aperture and a post on said free end of the other of said legs; said girdle engaging legs being initially larger than said girdle of said stone;

(b) squeezing together said legs to contact the girdle of said stone; and (c) fixedly securing said post by passing said post through said aperture to secure said legs together to hold said stone.

11. A method as claimed in claim 10 wherein the step of fixedly securing said legs together is performed by welding the post into said aperture.

12. A method as claimed in claim 10 wherein two housing are linked together at the same time said post is secured to said second of said legs by having said post of a first of said housing also pass through said aperture of an adjacent housing.

13. A jewelry mounting for a stone having a girdle, said mounting comprising a housing having a pair of opposed channel-shaped legs, each having a first end and a free end, said channel-shaped legs being capable of surrounding and securely holding said girdle of said stone from both above and below, said channel shaped legs meeting at said first ends in an extending ear having a first aperture therethrough, said free end of a first of said channel-shaped legs, opposite to said extending ear, having a post, smaller in diameter than said aperture, said free end of said second of said channel-shaped legs having a second aperture, said post passing through said second aperture and securable to the free end of said opposed channel shaped leg when said channel shaped legs are squeezed into contact with said girdle of said stone.

14. A jewelry mounting as claimed in claim 13 wherein said housing is a one-piece casting.

15. A jewelry mounting as claimed in claim 13 wherein said stone is oval and said channel-shaped legs are complimentary to the girdle of said stone.

16. A jewelry mounting as claimed in claim 13 wherein said stone is round and said channel-shaped legs are complimentary to the girdle of said stone.

17. An article of jewelry comprising two or more jewelry mountings as claimed in claim 13, wherein two or more of said housings are connected together into linked pairs by having said post of a first of said pair of housings pass through said aperture of said extending ear of a second housing of said pair.

18. A jewelry mounting as claimed in claim 13 wherein said channel-shaped legs, in cross section, are "V" shaped.

19. A jewelry mounting as claimed in claim 13 wherein said channel-shaped legs are, in cross section, complimentary to the girdle portion of said stone.

20. A jewelry mounting as claimed in claim 13 wherein said channel-shaped legs are manufactured from a material strong enough to safely secure said stone and resilient so as to be squeezed together to directly contact the girdle of said stone.

21. A jewelry mounting as claimed in claim 13 wherein said post is soldered to the free end of said second channel-shaped leg.

* * * * *